US012116711B2

(12) United States Patent
Welch et al.

(10) Patent No.: US 12,116,711 B2
(45) Date of Patent: Oct. 15, 2024

(54) WASHING MACHINE APPLIANCE AND A METHOD FOR PREVENTING OVERSUDS EVENTS

(71) Applicant: Haier US Appliance Solutions, Inc., Wilmington, DE (US)

(72) Inventors: Aaron Lee Welch, Louisville, KY (US); Ryan James Scheckelhoff, Louisville, KY (US); Ryan Ellis Leonard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 735 days.

(21) Appl. No.: 17/204,357

(22) Filed: Mar. 17, 2021

(65) Prior Publication Data

US 2022/0298694 A1 Sep. 22, 2022

(51) Int. Cl.

| | |
|---|---|
| ***D06F 33/37*** | (2020.01) |
| ***D06F 33/47*** | (2020.01) |
| *D06F 39/02* | (2006.01) |
| *D06F 103/16* | (2020.01) |
| *D06F 105/42* | (2020.01) |
| *D06F 105/52* | (2020.01) |

(52) U.S. Cl.

CPC ..... *D06F 33/37* (2020.02); *D06F 33/47* (2020.02); *D06F 39/02* (2013.01); *D06F 2103/16* (2020.02); *D06F 2105/42* (2020.02); *D06F 2105/52* (2020.02)

(58) Field of Classification Search

CPC ..... D06F 33/37; D06F 33/47

See application file for complete search history.

(56) References Cited

U.S. PATENT DOCUMENTS

2012/0019114 A1* 1/2012 Hong ..... D06F 39/02 312/228.1
2017/0175315 A1* 6/2017 Leep ..... D06F 39/02

FOREIGN PATENT DOCUMENTS

| | | | |
|---|---|---|---|
| CN | 111074481 | A | 4/2020 |
| CN | 111206369 | A | 5/2020 |
| KR | 20200121160 | A | 10/2020 |

* cited by examiner

*Primary Examiner* — Michael E Barr
*Assistant Examiner* — Kevin G Lee
(74) *Attorney, Agent, or Firm* — Dority & Manning, P.A.

(57) ABSTRACT

A washing machine appliance may include a tub, a basket, a valve, a spout, a dispenser, a motor, and a controller. The basket may be rotatably mounted and define a chamber for receipt of articles for washing. The valve may be disposed upstream from the tub. The spout may be directed at the tub downstream from the valve. The dispenser may be upstream from the tub for dispensing detergent into the tub. The motor may be in mechanical communication with the basket. The controller may be configured for controlling the washing machine appliance. The controller may be configured to initiate an oversuds-sensitive operation. The oversuds-sensitive operation may include detecting one or more resultant conditions from one or more previous wash cycles of the washing machine appliance, determining an adjusted operating parameter based on the detected resultant conditions, and directing detergent dispensing according to the adjusted operating parameter.

10 Claims, 4 Drawing Sheets

WASHING MACHINE APPLIANCE AND A METHOD FOR PREVENTING OVERSUDS EVENTS

FIELD OF THE INVENTION

The present subject matter relates generally to washing machine appliances and more particularly to methods for preventing oversuds events therein.

BACKGROUND OF THE INVENTION

Washing machine appliances generally include a tub for containing wash fluid (e.g., water, detergent, or bleach). A basket is rotatably mounted within the tub and defines a wash chamber for receipt of articles for washing. During operation of such washing machine appliances, wash fluid is directed into the tub and onto articles within the wash chamber of the basket. The basket can rotate at various speeds to agitate articles within the wash chamber in the wash fluid, to wring wash fluid from articles within the wash chamber, etc.

During operation of certain washing machine appliances, a spin cycle is performed to wring wash fluid from the articles within the wash chamber. The spin cycle typically entails rotating the basket at a relatively high rate of speed for a period of time. Typically, and desirably, the tub is generally empty of wash fluid and suds (caused by interaction between water and detergent, etc.). In some cases, however, an oversuds condition can occur, when suds remain in the tub during the spin cycle. If an oversuds condition or event occurs, the suds can overflow from the washing machine appliance and potentially damage, for example, surrounding floor areas or nearby electrical conditions. Such overflowing may also damage components of the washing machine appliance due to the extra stress placed on the appliance to handle the increased suds.

Furthermore, such oversuds conditions may result in a wet load because the washing machine appliance is not able to spin up to the recommended speed. As such, at the end of the cycle the articles may be soapy due to the washing machine appliance being unable to fully rinse the load. In addition, oversuds conditions may increase cycle time due to the washing machine appliance trying to solve the extra suds by adding extra rinse steps. Moreover, oversuds conditions may cause excessive drained current given the efforts to move the washing machine appliance under sudsing conditions.

As such, attempts have been made to reduce the risk of oversuds conditions in washing machine appliances. For example, additional water has been added before spin cycles in attempts to reduce suds within the tub and basket. In other instances, the speed at which the basket rotates during the spin cycle has been reduced. Further, in certain instances, the spin cycle ramp up period has been lengthened or reductions in recirculation have been made. However, these attempts have not suitably reduced the risk of oversuds conditions occurring and are often reactive rather than preventative.

Accordingly, improved washing machine appliances and methods for preventing oversuds conditions in washing machine appliances are desired.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method for preventing an oversuds condition in a washing machine appliance is provided. The method may include detecting one or more resultant conditions from one or more previous wash cycles of a washing machine appliance. The method may also include determining an adjusted operating parameter based on the detected resultant conditions. The method may further include directing detergent dispensing according to the adjusted operating parameter.

In one exemplary aspect of the present disclosure, a washing machine appliance is provided. The washing machine appliance may include a tub, a basket, a valve, a spout, a dispenser, a motor, and a controller. The basket may be rotatably mounted within the tub. The basket may define a chamber for receipt of articles for washing. The valve may be disposed upstream from the tub. The spout may be directed at the tub downstream from the valve. The dispenser may be upstream from the tub for dispensing detergent into the tub. The motor may be in mechanical communication with the basket. The controller may be configured for controlling the washing machine appliance. The controller may be configured to initiate an oversuds-sensitive operation. The oversuds-sensitive operation may include detecting one or more resultant conditions from one or more previous wash cycles of the washing machine appliance, determining an adjusted operating parameter based on the detected resultant conditions, and directing detergent dispensing according to the adjusted operating parameter.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
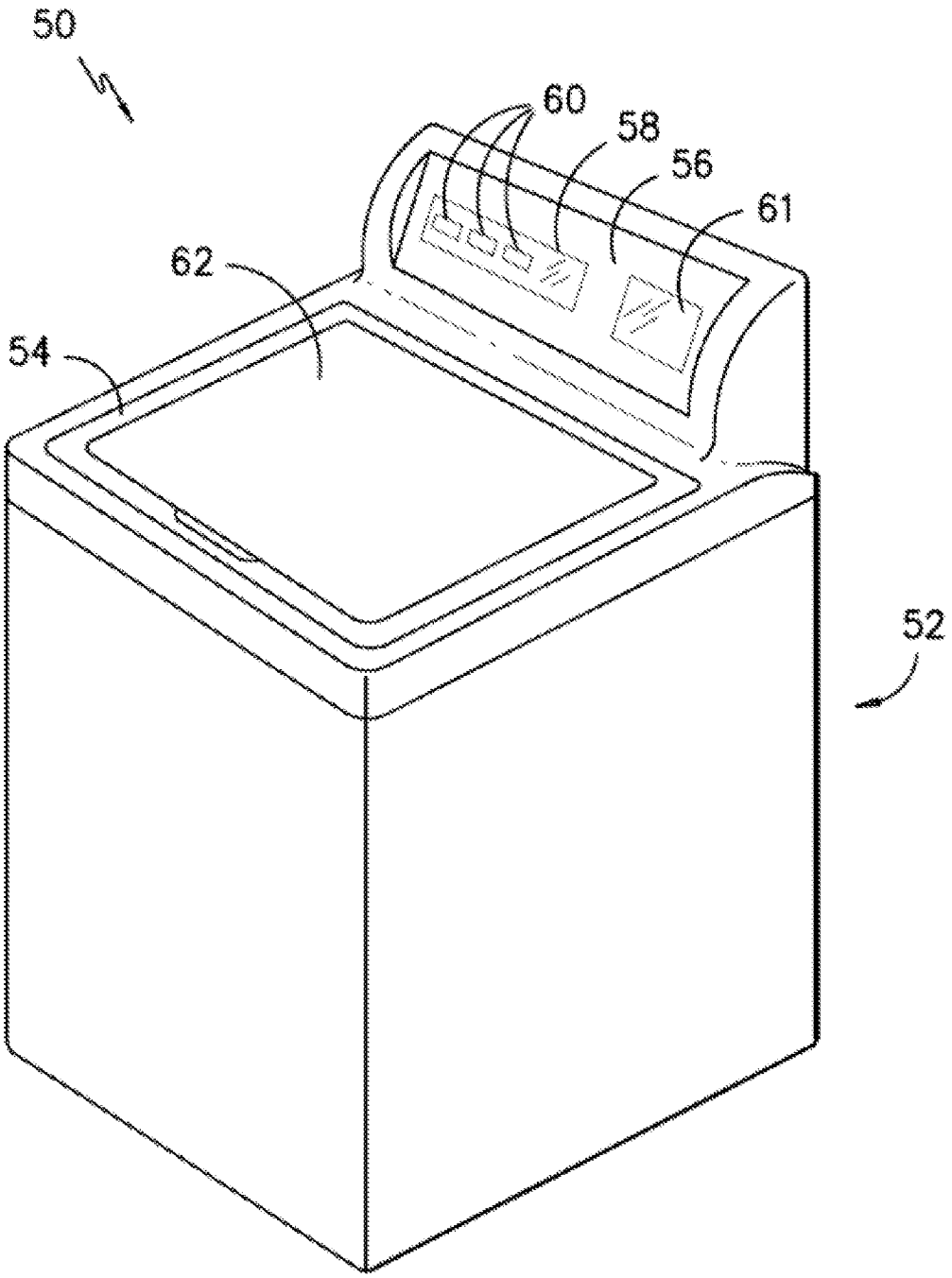
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Referring now to the figures, FIG. 1 illustrates a perspective view of a washing machine appliance 50 according to an exemplary embodiment of the present subject matter. As may be seen in FIG. 1, the washing machine appliance 50 includes a cabinet 52 and a cover 54. A backsplash 56 extends from the cover 54, and a control panel 58 including a plurality of input selectors 60 is coupled to backsplash 56. The control panel 58 and input selectors 60 collectively form a user interface input for operator selection of machine cycles and features, and in one embodiment, a display 61 indicates selected features, a countdown timer, or other items of interest to machine users. A lid 62 is mounted to the cover 54 and is rotatable between an open position (not shown) facilitating access to a wash tub 64 (FIG. 2) located within the cabinet 52 and a closed position (shown in FIG. 1) forming an enclosure over the tub 64.

Figure 2:
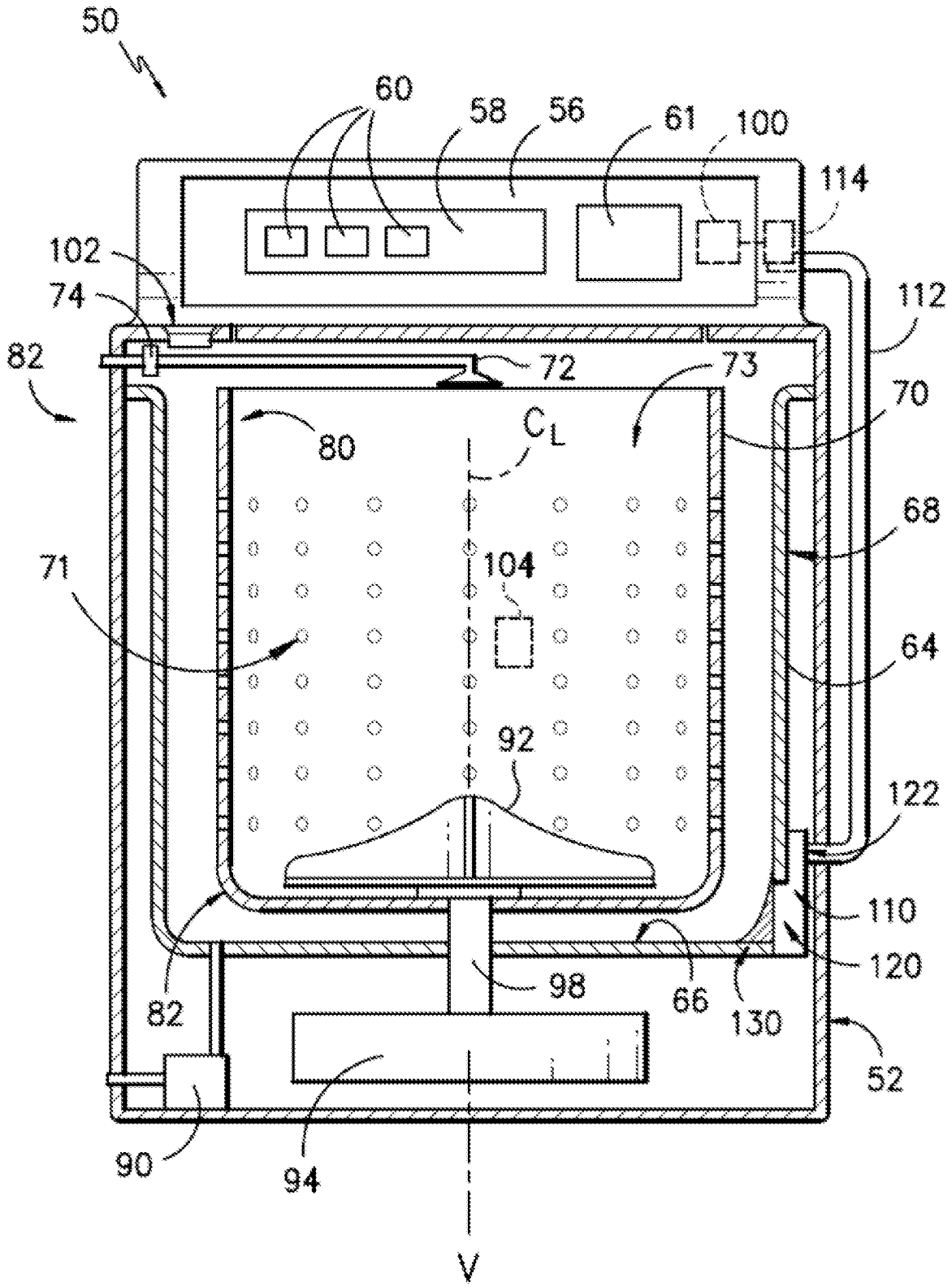
FIG. 2 provides a front, cross-sectional view of the exemplary washing machine appliance of FIG. 1.

Referring now to FIG. 2, a front, cross-sectional view of the washing machine appliance 50 is illustrated. As may be seen in FIG. 2, the tub 64 includes a bottom wall 66 and a sidewall 68. A wash basket or wash drum 70 is rotatably mounted within the tub 64. In exemplary embodiments as shown, the basket 70 is rotatable about a vertical axis V. Thus, the washing machine appliance 50 in these embodiments is generally referred to as a vertical axis washing machine appliance. Further, as shown, the basket 70 defines a wash chamber 73 for receipt of articles for washing and extends, for example, vertically, between a bottom portion 80 and a top portion 82. The basket 70 includes a plurality of openings or perforations 71 therein to facilitate fluid communication between an interior of the basket 70 and the tub 64.

A spout 72 is configured for directing a flow of fluid into the tub 64. In particular, the spout 72 may be positioned at or adjacent to the top portion 82 of the basket 70. The spout 72 may be in fluid communication with a water supply (not shown) in order to direct fluid (e.g., liquid water) into the tub 64 or onto articles within the chamber 73 of the basket 70. A valve 74 regulates the flow of fluid through the spout 72. For example, the valve 74 can selectively adjust to a closed position in order to terminate or obstruct the flow of fluid through the spout 72. A pump assembly 90 (shown schematically in FIG. 2) is located beneath the tub 64 and the basket 70 for gravity assisted flow to drain the tub 64.

Still referring to FIG. 2, an agitation element 92, shown as an impeller in FIG. 2, is disposed in the basket 70 to impart an oscillatory motion to articles and liquid in the chamber 73 of the basket 70. In various embodiments, the agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, the agitation element 92 is oriented to rotate about vertical axis V. The basket 70 and the agitation element 92 are driven by a pancake motor 94. Thus, as a motor output shaft 98 is rotated, the basket 70 and the agitation element 92 are operated for rotatable movement within the tub 64 (e.g., about vertical axis V). Further, the washing machine appliance 50 may also include a brake assembly (not shown) selectively applied or released for respectively maintaining the basket 70 in a stationary position within the tub 64 or for allowing the basket 70 to spin within the tub 64.

Operation of the washing machine appliance 50 is controlled by a processing device or controller 100, that is operatively coupled to the user interface input located on washing machine backsplash 56 (shown in FIG. 1) for user manipulation to select washing machine cycles and features. As such, in response to user manipulation of the user interface input, the controller 100 operates the various components of the washing machine appliance 50 to execute selected machine cycles and features.

The controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor (e.g., using a combination of discrete analog or digital logic circuitry; such as switches, amplifiers, integrators, comparators, flip-flops, AND gates, and the like; to perform control functionality instead of relying upon software). Control panel 58 and other components of washing machine appliance 50 may be in communication with controller 100 via one or more signal lines or shared communication busses.

In an illustrative embodiment, laundry items are loaded into the chamber 73 of the basket 70, and washing operation is initiated through operator manipulation of control input selectors 60. The tub 64 is filled with water and mixed with detergent to form a wash fluid. The valve 74 can be opened to initiate a flow of water into the tub 64 via the spout 72, and the tub 64 can be filled to the appropriate level for the amount of articles being washed. In certain embodiments, the detergent may be poured directly into the basket 70 via a user. In alternative embodiments, the washing machine appliance 50 may be further equipped with a detergent dispenser 102 (FIG. 2) in which the detergent may be poured. In certain embodiments, as an example, the dispenser 102 may be a smart or bulk dispenser (e.g., that can be controlled via the controller 100 as further described herein). For instance, dispenser 102 may include a bulk dispenser tank configured to hold a suitable volume of detergent for multiple wash cycles as well as a controller-actuated valve or motor configured to selectively release a determined volume of detergent to the tub 64, as would be understood. Once the tub 64 is properly filled with wash fluid, the contents of the basket 70 are agitated with the agitation element 92 for cleaning of laundry items in the basket 70. More specifically, the agitation element 92 is moved back and forth in an oscillatory motion.

After the agitation phase of the wash cycle is completed, the tub 64 is drained. Laundry articles can then be rinsed by again adding fluid to the tub 64, depending on the particulars of the cleaning cycle selected by a user, the agitation element 92 may again provide agitation within the basket 70. One or more spin cycles may also be used. In particular, a spin cycle may be applied after the wash cycle or after the rinse cycle in order to wring wash fluid from the articles being washed. During a spin cycle, the basket 70 is rotated at relatively high speeds.

While described in the context of a specific embodiment of the washing machine appliance 50, using the teachings disclosed herein it will be understood that the washing machine appliance 50 is provided by way of example only. Other washing machine appliances having different configurations (such as horizontal-axis washing machine appliances), different appearances, or different features may also be utilized with the present subject matter as well.

Referring still to FIG. 2, a pressure chamber 110 may be defined in the tub 64. The pressure chamber 110 may be provided for facilitating tub pressure measurements. For example, a hose 112 may connect the pressure chamber 110 to a pressure sensor 114. The pressure sensor 114 may measure the pressure in the pressure chamber 110 or at another suitable location within the tub 64, and may be in operative communication with the controller 100. The pressure sensor 114 may be a component of the controller 100, or may be a separate component from the controller 100 which is in communication with the controller 100 through a suitable wired or wireless connection. The pressure sensor 114 may, for example, be an analog pressure sensor, a digital pressure sensor, a mechanical pressure switch, or any other suitable device capable of measuring pressure as required herein. The pressure chamber 110 may include an inner opening 120 and an outer opening 122, and may extend between these openings to place the interior of the tub 64 and the hose 112 in fluid communication. The inner opening 120 may thus be defined in a sidewall 68 of the tub 64.

Further, a deflector 130 may be disposed within and mounted to the tub 64, such as to a sidewall 68 or tub bottom 66 thereof. The deflector 130 generally extends inwardly from the sidewall 68 and the tub bottom 66 between the tub 64 and the basket 70, and deflects and redirects water therein. The inner opening 120 may be defined adjacent to the deflector 130, such that the deflector 130 redirects water from the inner opening 120.

Figure 3:
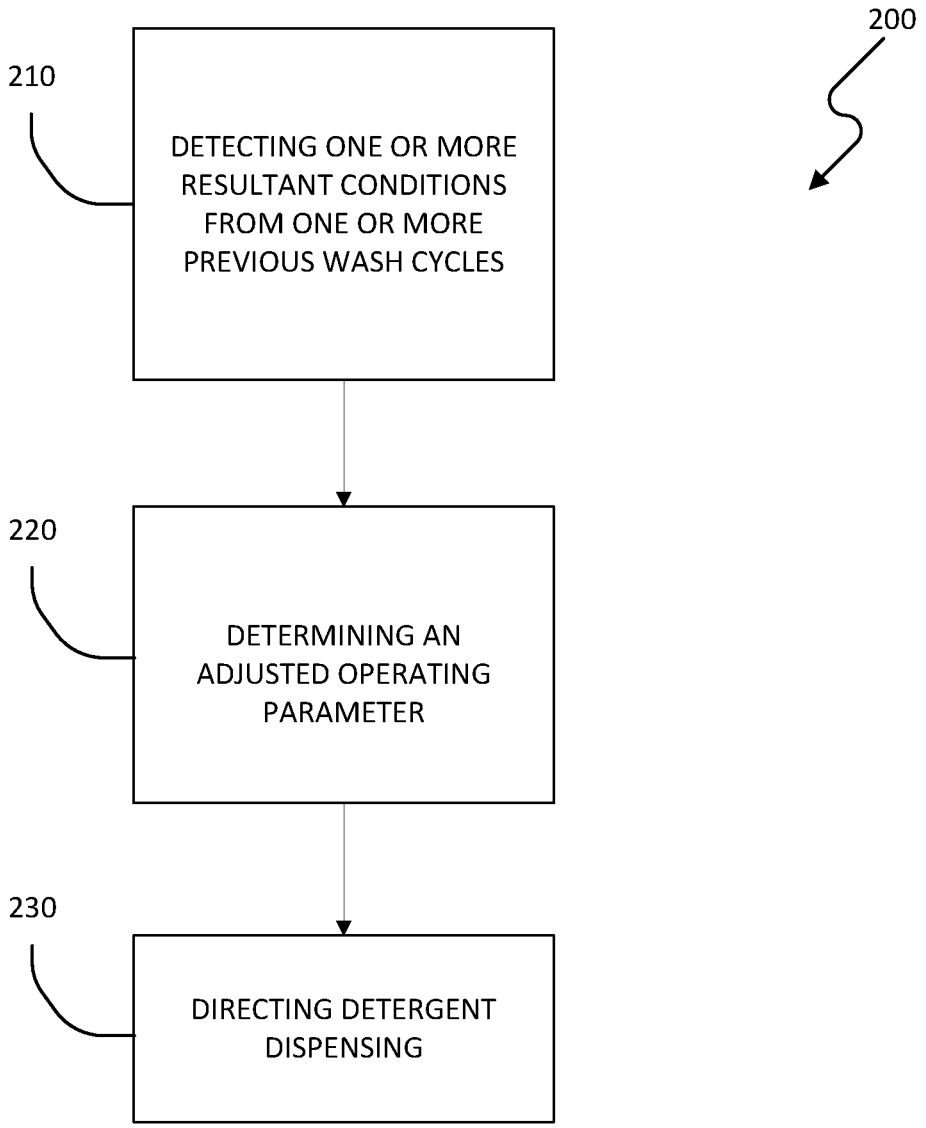
FIG. 3 provides a flow chart illustrating a method according to an exemplary embodiment of the present disclosure.

As discussed, improved methods and apparatus for preventing oversuds events or conditions are desired in the art. The present disclosure is thus further directed to methods for preventing oversuds conditions in washing machine appliances. Such methods may advantageously reduce leakages and other issues caused by oversuds conditions by efficiently preventing such conditions. As used herein, an oversuds condition generally refers to a condition wherein excess fluids, such as wash fluids and suds, are present in a tub. Accordingly, as shown in FIG. 3, a flow diagram of one embodiment of a method 200 for preventing an oversuds condition in a washing machine appliance is illustrated. In general, the method 200 is described herein as relating to washing machine appliance 50 (e.g., as executed by controller 100 as an oversuds-sensitive operation). However, it should be appreciated that the disclosed method 200 may be implemented using any other suitable washing machine appliance now known or later developed in the art. In addition, although FIG. 3 depicts steps performed in a particular order for purposes of illustration and discussion, the methods described herein are not limited to any particular order or arrangement. One skilled in the art, using the disclosures provided herein, will appreciate that various steps of the methods can be omitted, rearranged, combined, or adapted in various ways.

At 210, the method 200 includes detecting one or more resultant conditions from one or more previous wash cycles of the washing machine appliance. For example, the resultant conditions described herein may include an amount of detergent, a type of detergent, suds generation, a number of oversuds events, or a fluid temperature for the one or more previous wash cycles. In certain embodiments, 210 includes detecting an oversuds event for the one or more previous wash cycles. Furthermore, multiple previous wash cycles may be required to include a discrete detected oversuds event. In other words, a predetermined number of previous wash cycles may be required to be executed in which an oversuds event is detected. Thus, 210 may include detecting a predetermined threshold number of events for the multiple previous wash cycles. Optionally, the predetermined threshold number may be a successive number requiring the discrete oversuds events to occur over successive previous wash cycles. In turn, 210 may require separate threshold events to be detected over successive wash cycles (i.e., without interruption by a wash cycle in which an oversuds event is not detected).

Generally, the detergent parameter(s) may be determined using any suitable methods. For example, the method 200 may include determining the suds generation from the previous wash cycle(s) using an existing algorithm of the washing machine appliance. In particular, one or more oversuds events may be determined based on a detected torque required to spin the wash basket at a predetermined speed or based on a detected suds level signal, both of which would be understood by one of ordinary skill in the art.

At 220, the method 200 includes determining an adjusted operating parameter based on the detected resultant conditions. In some embodiments, the adjusted operating parameter is a detergent parameter that is reduced based on the detected resultant conditions. For instance, the amount (e.g., volume or mass) of detergent to be dispensed in a future wash cycle may be reduced.

As an example, a predetermined detergent amount may be reduced by a set offset value. Thus, 220 may include applying the set offset value to the predetermined detergent amount (e.g., subtracting the set offset value from the predetermined detergent amount) to generate a reduced detergent amount for the future wash cycle.

As another example, a predetermined detergent may be reduced according to an adjustment factor (e.g., a fixed or variable reduction factor). The adjustment factor may be used to calculate the operating parameter. In some such embodiments, 220 includes applying the adjustment factor to the predetermined detergent amount (e.g., multiplying the predetermined detergent amount by the adjustment factor) to generate a reduced detergent amount for a future wash cycle. For example, the controller may apply the adjustment factor (e.g., 95%, 90%, etc.) to the amount of detergent for the future wash cycle to change the amount of detergent for the future wash cycle based on the adjustment factor. In certain embodiments, 220 includes correlating the adjusted operating parameter (e.g., the previous number of oversuds events) from the previous wash cycles with the adjustment factor. Thus, the adjustment factor may be proportional to the number of detected oversuds events from previous wash cycles.

Optionally, a lower limit of detergent may be established such that the amount of detergent for a future wash cycle may never be reduced below the lower limit. In turn, 220 may include determining the reduced detergent amount is less than a set minimum detergent amount (i.e., lower limit). In response to determining the reduced detergent amount is less than a set minimum detergent amount, 220 can further include selecting the minimum detergent amount as the adjusted operating parameter.

In certain embodiments, the predetermined amount of detergent (from which the reduced detergent amount may be determined) is programmed as a fixed (e.g., unchanging default) value within the controller. In alternative embodiments, the predetermined amount is a variable value within the controller. For instance, the variable amount may be set as or based on the detergent amount of one or more previous wash cycles. Optionally, the predetermined amount may be set as whatever detergent amount was used in the most recent previous wash cycle. Alternatively, the predetermined amount may be set as a mean (or otherwise modified) value of the detergent amounts of multiple previous wash cycles.

At 230, the method 200 includes directing detergent dispensing according to the adjusted operating parameter. In other words, the detergent may be dispensed or selectively released from the detergent dispenser in accordance with the adjusted operating parameter. For instance, the detergent dispenser may be directed to dispense the reduced detergent amount (or minimum detergent amount) to the tub for the future wash cycle.

Figure 4:
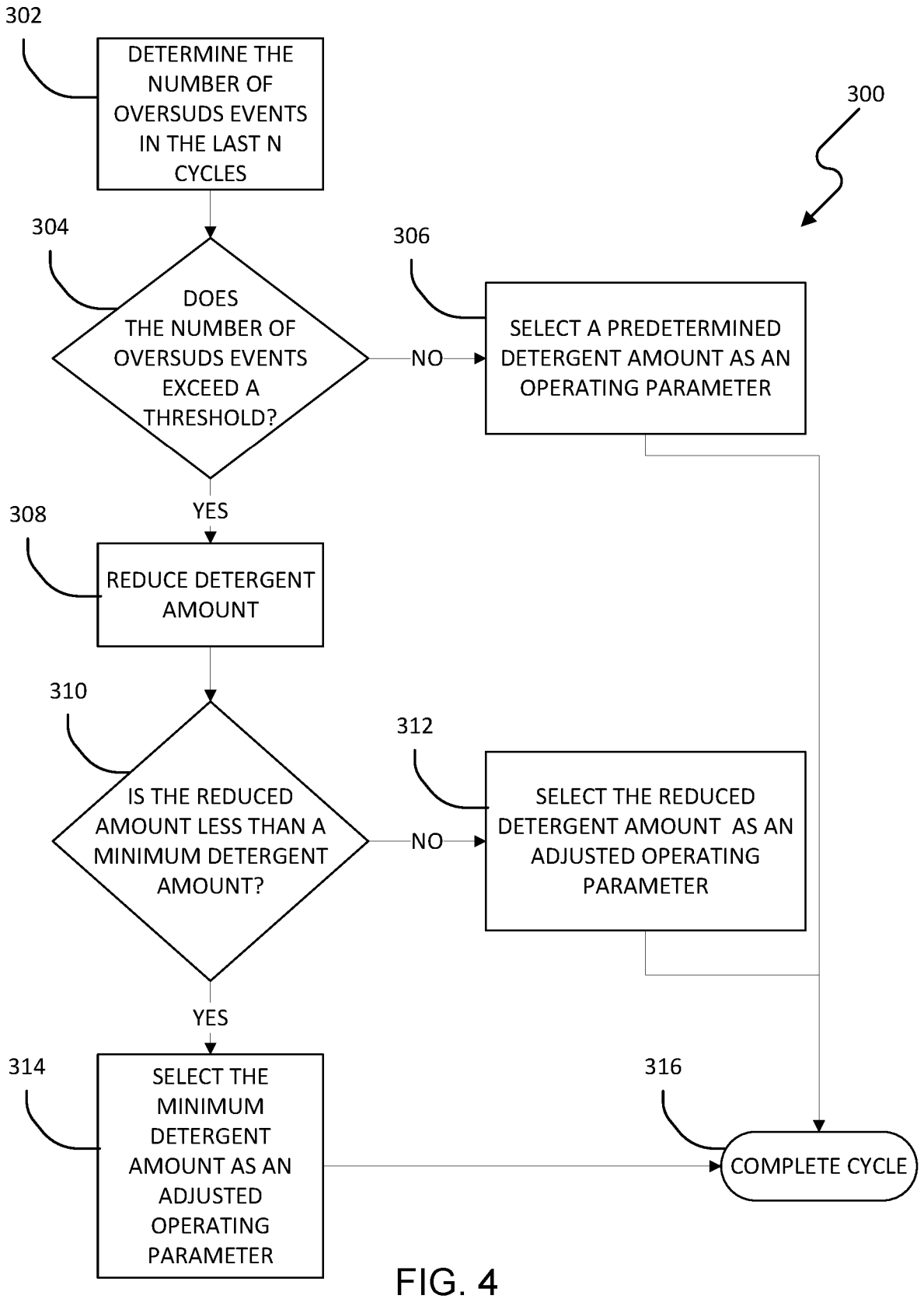
FIG. 4 provides a flow chart of an implementation of the controller to prevent an oversuds condition in a washing machine appliance according to an exemplary embodiment of the present disclosure.

Referring now to FIG. 4, a flow chart 300 of another implementation of the controller 100 to prevent an oversuds condition in a washing machine appliance according to the present disclosure is illustrated. As shown, at 302 the controller 100 determines the number of oversuds events in the last (e.g., previous) N wash cycles (e.g., prior to initiating or completing a future wash cycles). The variable N may be a successive number of past wash cycles (e.g., last 3 wash cycles, 5 wash cycles, etc.). As shown, at 304 the controller 100 may determine whether the number of oversuds events determined at 302 exceeds a predetermined threshold. If not, as shown at 306, the controller 100 selects a predetermined detergent amount as an operating parameter for the future wash cycle. If so, as shown at 308, the controller 100 reduces a detergent amount for the future wash cycle. As shown at 310, the controller 100 determines if the reduced detergent amount is less than a minimum detergent amount. If not, as shown at 312, the controller 100 selects the reduced detergent amount as an adjusted operating parameter for the future wash cycle. If so, as shown at 314, the controller 100 selects the minimum detergent amount as the adjusted operating parameter. Following the selection of the appropriate amount of detergent, the dispenser 102 dispenses the appropriate amount of detergent and continues the wash cycle. The cycle ends at 326.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a tub;

a basket rotatably mounted within the tub, the basket defining a chamber for receipt of articles for washing;

a valve disposed upstream from the tub;

a spout directed at the tub downstream from the valve;

a dispenser upstream from the tub for dispensing detergent into the tub;

a motor in mechanical communication with the basket; and a controller configured for controlling the washing machine appliance, the controller configured to initiate an oversuds-sensitive operation comprising detecting one or more resultant conditions from one or more previous wash cycles of the washing machine appliance, determining an adjusted operating parameter based on the detected resultant conditions, and directing detergent dispensing according to the adjusted operating parameter, wherein determining the adjusted operating parameter comprises applying an adjustment factor or set offset value to a predetermined detergent amount to generate a reduced detergent amount for a future wash cycle, determining the reduced detergent amount is less than a set minimum detergent amount, the set minimum detergent amount comprising a variable value based on a detergent amount of the one or more previous wash cycles, and selecting the set minimum detergent amount as the adjusted operating parameter in response to determining the reduced detergent amount is less than a set minimum detergent amount.

2. The washing machine appliance of claim 1, wherein the one or more resultant conditions comprises an amount of detergent, a type of detergent, suds generation, a number of oversuds events, or a fluid temperature for the one or more previous wash cycles.

3. The washing machine appliance of claim 1, wherein detecting one or more resultant conditions comprises detecting an oversuds event for the one or more previous wash cycles.

4. The washing machine appliance of claim 3, wherein detecting one or more resultant conditions requires detecting discrete oversuds events for multiple previous wash cycles.

5. The washing machine appliance of claim 4, wherein the discrete oversuds events comprises a predetermined threshold number of events for the multiple previous wash cycles.

6. The washing machine appliance of claim 5, wherein the predetermined threshold number is a successive number requiring the discrete oversuds events to occur over successive previous wash cycles.

7. The washing machine appliance of claim 1, wherein determining the adjusted operating parameter comprises applying the set offset value to the predetermined detergent amount to generate the reduced detergent amount for the future wash cycle.

8. The washing machine appliance of claim 1, wherein determining the adjusted operating parameter comprises applying the adjustment factor to the predetermined detergent amount to generate the reduced detergent amount for the future wash cycle.

9. The washing machine appliance of claim 8, wherein determining the adjusted operating parameter further comprises determining the reduced detergent amount is less than a set minimum detergent amount, and selecting the set minimum detergent amount as the adjusted operating parameter in response to determining the reduced detergent amount is less than a set minimum detergent amount.

10. A washing machine appliance, comprising:

a tub;

a basket rotatably mounted within the tub, the basket defining a chamber for receipt of articles for washing;

a valve disposed upstream from the tub;

a spout directed at the tub downstream from the valve;

a dispenser upstream from the tub for dispensing detergent into the tub;

a motor in mechanical communication with the basket; and a controller configured for controlling the washing machine appliance, the controller configured to initiate an oversuds-sensitive operation comprising detecting one or more resultant conditions from one or more previous wash cycles of the washing machine appliance, each previous cycle of the one or more previous wash cycles being applied to a discrete load of articles prior to initiation of the oversuds-sensitive operation, determining an adjusted operating parameter based on the detected resultant conditions, and directing detergent dispensing according to the adjusted operating parameter, wherein detecting one or more resultant conditions requires detecting discrete oversuds events for multiple previous wash cycles, the discrete oversuds events comprising a predetermined threshold number of events for the multiple previous wash cycles, the predetermined threshold number of events being a successive number requiring the discrete oversuds events to occur over successive previous wash cycles, and wherein determining the adjusted operating parameter comprises applying an adjustment factor or set offset value to a predetermined detergent amount to generate a reduced detergent amount for a future wash cycle, determining the reduced detergent amount is less than a set minimum detergent amount, the set minimum detergent comprising a variable value based on a detergent amount of the one or more previous wash cycles, and selecting the set minimum detergent amount as the adjusted operating parameter in response to determining the reduced detergent amount is less than a set minimum detergent amount.

* * * * *